US006030296A

United States Patent [19]

Morgan et al.

[11] Patent Number: 6,030,296

[45] Date of Patent: Feb. 29, 2000

[54] WOUND GOLF BALL

[75] Inventors: William E. Morgan, Barrington, R.I.; Jeffrey L. Dalton, Dartmouth; Christopher Cavallaro, Lakeville, both of Mass.

[73] Assignee: Acushnet Company, Fairhaven, Mass.

[21] Appl. No.: 09/258,388

[22] Filed: Feb. 26, 1999

[51] Int. Cl.[7] ..... A63B 37/02; A63B 45/00

[52] U.S. Cl. ..... 473/361; 156/186; 156/190

[58] Field of Search ..... 156/186, 190; 473/351, 354, 356, 357, 361

[56] References Cited

U.S. PATENT DOCUMENTS

| | | | |
|---|---|---|---|
| 785,184 | 3/1905 | Saunders | 156/186 X |
| 972,313 | 10/1910 | Worthington | 473/362 |
| 1,982,218 | 11/1934 | Martin | 156/186 X |
| 4,272,079 | 6/1981 | Nakade et al. | 473/363 |
| 5,006,297 | 4/1991 | Brown et al. | 264/234 |
| 5,334,673 | 8/1994 | Wu | 473/378 |
| 5,484,870 | 1/1996 | Wu | 528/28 |
| 5,685,785 | 11/1997 | Kakiuchi et al. | 473/354 |
| 5,704,853 | 1/1998 | Maruko et al. | 473/351 X |
| 5,733,428 | 3/1998 | Calabria et al. | 264/134 |
| 5,766,096 | 6/1998 | Maruko et al. | 473/351 X |
| 5,810,677 | 9/1998 | Maruko et al. | 473/357 |
| 5,813,923 | 9/1998 | Cavallaro et al. | 473/373 |

FOREIGN PATENT DOCUMENTS

| | | |
|---|---|---|
| 705017 | 3/1965 | Canada . |
| 1428816 | 4/1969 | Germany . |
| 1021424 | 3/1966 | United Kingdom . |
| 1321269 | 6/1973 | United Kingdom . |
| 1321270 | 6/1973 | United Kingdom . |

*Primary Examiner*—John A. Ricci
*Attorney, Agent, or Firm*—Pennie & Edmonds LLP

[57] ABSTRACT

The present invention is directed towards a wound golf ball that includes a wound core surrounded with a cover material. The wound core is formed of a fluid-filled or solid center, and at least one wound layer segment surrounding the center. The wound layer segment includes a first untreated portion, a first impregnated portion, a second untreated portion and a second impregnated portion. The first impregnated portion is impregnated with a first material, such as latex. In one embodiment, the wound layer segment is formed of two layers, each having an untreated and an impregnated portion. Thus, the multi-layered wound layer segment has an impregnated portion between two untreated portions.

22 Claims, 3 Drawing Sheets

WOUND GOLF BALL

FIELD OF THE INVENTION

This invention relates generally to golf balls, and more particularly to improved wound golf balls having a wound core construction incorporating a liquid material, such as latex, therein.

BACKGROUND OF THE INVENTION

Conventional golf balls can be divided into two general types or groups: solid balls or wound balls. The difference in play characteristics resulting from these different types of constructions can be quite significant.

Solid balls with a two-piece construction are generally most popular with the average recreational golfer, because they provide a very durable ball while also providing maximum distance. Two piece solid balls are made with a single solid core, usually made of a crosslinked rubber, which is encased by a hard cover material. The combination of the core and cover materials, which are very rigid, provide a "hard" feel for the ball when it is struck with a club and provide a ball that is virtually indestructible by golfers. This combination of materials imparts a high initial velocity to the ball, which results in improved distance. In addition, due to this combination these balls have a relatively low spin rate which provides greater distance.

At the present time, the wound ball remains the preferred ball of the more advanced players due to its spin and feel characteristics. Wound balls typically have either a solid rubber or fluid-filled center around which many yards of a stretched elastic thread or yam are wrapped to form a wound core. The wound core is then covered with a durable cover material, such as a SURLYN® or similar material, or a softer "performance" cover, such as balata or polyurethane. The cover material adheres to the wound core.

Typically, a single strand of thread is employed in forming the wound core. This thread can be wrapped at variable tension as disclosed in U.S. Pat. No. 4,783,078 issued to Giza. However, some balls have used two different threads of different dimensions to form the wound core. In this case, the inner most thread may be wound at a different tension and with a different pattern than the outer most thread. Furthermore, the outer most thread is generally wound in a more open pattern to form larger gaps between the thread to assure good amalgamation between the cover and the wound core.

The United States Golf Association (USGA), the organization that sets the rules of golf in the United States, has instituted a rule that prohibits the competitive use in any USGA sanctioned event of a golf ball that can achieve an initial velocity of 76.2 meters per second (m/s), or 250 ft/s, when tested in a standardized device operated by the USGA (referred to hereinafter as "the USGA test"). However, an allowed tolerance of 2 percent permits manufacturers to produce golf balls that achieve an initial velocity of up to 77.7 m/s (255 ft/s).

Players generally seek a golf ball that delivers maximum distance, which requires a high initial velocity upon impact. Therefore, in an effort to meet the demands of the marketplace, manufacturers strive to produce golf balls with initial velocities in the USGA test that approximate the USGA maximum of 77.7 m/s or 255 ft/s as closely as possible. Manufacturers try to provide these balls with a range of different properties and characteristics, such as spin and compression.

To meet the needs of golfers having varying levels of skill, golf ball manufacturers are also concerned with varying the compression of the ball, which is a measurement of the deformation of a golf ball under a fixed load. A ball with a higher compression feels harder than a ball of lower compression. With initial velocities in the range of 245 to 255 ft/sec in the USGA test, wound golf balls generally have a lower compression which is preferred by better players. Whether wound or solid, all golf balls become more resilient (i.e., have higher initial velocities) as compression increases. Manufacturers of both wound and solid construction golf balls must balance the requirement of higher initial velocity from higher compression with the desire for a softer feel from lower compression.

Wound balls generally have lower compression. Thus, wound balls are softer and provide more spin than solid balls. These characteristics enable a skilled golfer to have more control over the ball's flight and final position. Particularly, with approach shots into the green, the high spin rate of soft covered wound balls enables the golfer to stop the ball very near its landing position. However, soft covered wound balls with their lower compression exhibit a lower initial velocity than hard covered solid balls. This in combination with a higher spin rate than solid balls means wound balls generally display shorter distance than hard covered solid balls. However, the advantages of wound constructions over solid ones are more related to targeting or accuracy than distance.

A softer feel is the result of a lower compression, but feel is also affected by cover hardness and thickness. In wound constructions, a thinner cover will have a softer feel, so manufacturers strive to produce balls with the thinnest possible covers. The cover of a wound ball includes two distinct portions, which are the surface portion and the inner portion. The surface portion consists entirely of cover material. The inner portion is in contact with the wound core, and is essentially an amalgam of cover and windings. This cover inner portion is formed as the cover penetrates the windings during the cover molding process and displaces the air trapped in the wound core. The density of the windings affects the thickness of the cover inner portion, but factors related to the cover will also affect this thickness. Using techniques unique to each cover molding method, manufacturers control the depth to which the cover material penetrates the wound core, and thus the thickness of the cover inner portion. In compression molding, the cover melt flow index, mold temperature and pressures control the thickness of cover inner portion.

One purpose of dipping a wound core in a light latex material is to control the thickness of the cover inner portion. Another purpose of a light latex material is to prevent the wound core from unwrapping prior to it being covered, which would result in an un-playable ball. For example, in balls whose covers are formed in a liquid casting process such as U.S. Pat. Nos. 5,006,297 and 5,733,428, the conventional wound cores are treated by submersion in a light latex material prior to covering. "Light" latex material is one with a particular combination of percentage solids applied using a particular submersion time. For a light latex material, the greater the percentage of solids, the shorter the submersion time, and when the percentage of solids decreases the submersion time increases. For example, a light latex material is formed of about 5% solids applied using a submersion time of less than eight seconds, as disclosed in U.S. Pat. No. 5,006,297. Also, light latex material as disclosed in U.S. Pat. No. 5,733,428 is one formed of about 30%–60% solids and applied using a submersion time of less than eight seconds. A "heavier" latex application on the outer surface of the wound core reduces the amalgamation of the cover with the windings. Thus, an excessive application of latex on the outer surface of the wound core interferes with core-cover adhesion decreasing cover durability.

Another purpose of this light latex material is to seal in any air trapped between the innermost threads. If the air is not trapped, it can rise to the surface of the cover during the covering process and form air bubbles. Since these air bubbles are visible through the cover, they are undesirable imperfections in the cover. However, as discussed above, a heavier application of the latex material can be problematic, for example, it can decrease adhesion of the cover material to the wound core.

Golf ball manufacturers are continually searching for new ways in which to provide wound golf balls that deliver the maximum performance for golfers. It would be advantageous to provide such a wound golf ball with good cover adhesion. The present invention provides such a wound golf ball.

DESCRIPTION OF THE PRIOR ART

Several patents have been issued which are directed towards wound golf balls with rubber therein. The inventions disclosed in the prior art patents are directed towards improving the characteristics of the wound balls.

Referring to FIG. 1, as disclosed in U.S. Pat. No. 972,313 issued to Worthington a wound ball 10 includes a center 12, a first wound layer 14, a weighted unvulcanized rubber layer 16, a second wound layer 18, and a cover 20. The first wound layer 14 is wound on the core 12 at a lower tension than the second wound layer 18. The weighted unvulcanized rubber layer 16 is made of a sheet rubber laid on the first wound layer 14 as evenly as possible and made heavy by the addition thereto of a suitable heavy mineral powder for increasing the ball's weight. The second wound layer 18 covers the rubber layer 16, and the cover 20 is formed on the second wound layer 18. Thus, three separate layers are formed between the center 12 and the cover 20.

Referring to FIG. 2, as disclosed in U.S. Pat. No. 4,272,079 issued to Nakade et al., a wound ball 30 includes a single wound thread layer 32 over a center 34 forming a wound core. This wound core is covered with a latex containing ionomer resin that impregnates the thread layer 32 to form a portion 32*a*, which is only thread, and a portion 32*b*, which is thread with latex. A cover 38 is formed on the core. The cover contains an ionomer resin that forms a portion 32*c*, which is thread with cover material therein. Since the latex and cover are formed with ionomer resin, the portions 32*c* and 32*b* are integrally connected to the cover 38 via the ionomer resin. The purpose of the latex is to improve the connection between the cover 38 and the wound layer 32.

Referring to FIG. 3, as disclosed in U.K. Patent No. 1,021,424, a wound ball 50 includes a center 52 and a rubber tape layer 54 wound on the center 52. The ball 50 further includes a first layer 56 of rubber thread wound on the tape layer 54. This forms a wound core, which is immersed in a natural rubber latex, which fills the interstices between the rubber threads, to form a thread portion 56*a* and a barrier surface 56*b* on top of the thread portion 56*a*. Then a second layer 60 of thread is wound thereon. The cover 62 is applied to the second layer 60 so that the cover 62 penetrates the second layer 60 to the barrier surface 56*b*. The barrier surface 56*b* acts as a depth control for preventing the penetration of the cover material to a substantial degree inwardly toward the center 52. Thus, the latex material and the cover material are in contact, and the latex material effectively behaves as an extension of the cover into the thread layer 56. This creates an undesirably thick cover.

The U.S. Pat. Nos. 5,006,297 and 5,733,428 assigned to Acushnet and related to urethane balls, as discussed above, have a light application of latex on the outer surface of the wound core, which primarily prevents the thread from unwrapping prior to casting on the cover.

However, these patents do not disclose a wound ball having the material and configuration as disclosed herein to provide the improved golf balls of the present invention.

SUMMARY OF THE INVENTION

The present invention is directed towards a wound golf ball that includes a wound layer segment between a center and a cover layer. The center is a fluid-filled or solid center and may be of any composition or diameter. The wound layer segment includes, as disposed in a radially outwardly extending direction, a first untreated portion, a first impregnated portion, a second untreated portion and a second impregnated portion. The untreated portions contain only thread. The impregnated portions have a first and second material, respectively, partially impregnated between the threads of that portion. The first material is applied in a liquid state and dries into a flexible film. In one embodiment, the second material is a cover material that also forms the cover layer. It is preferred that the wound layer segment is formed of a first wound layer and a second wound layer, where each layer has respective untreated and impregnated portions therein.

According to one embodiment, the first material is a heavy latex that is formed of about 30% to about 70% solids and applied by submerging the center with innermost windings for about 10 seconds to about 60 seconds.

The invention thus provides a novel golf ball configuration that offers the benefit of enhanced performance properties.

DETAILED DESCRIPTION OF THE PREFERRED EMBODIMENTS

Figure 1:
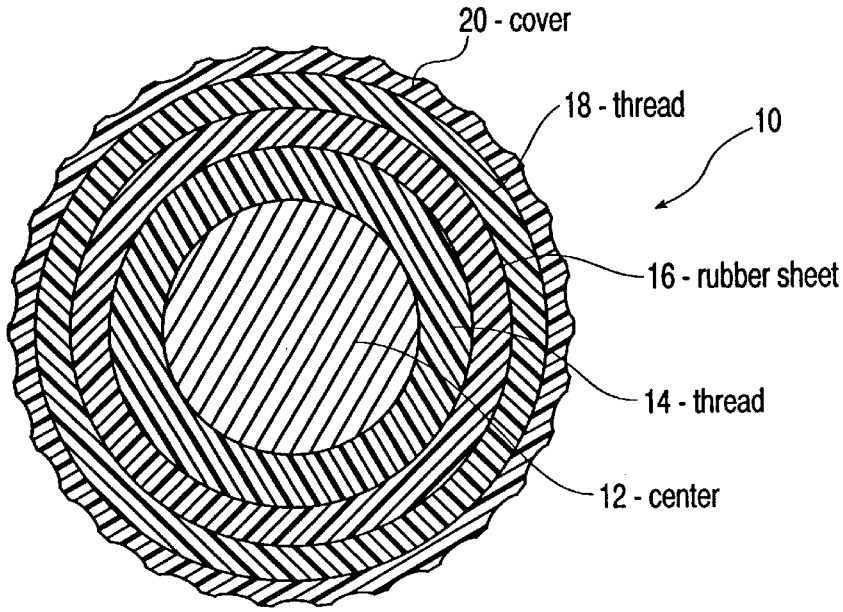
FIG. 1 PRIOR ART
FIGS. 1–3 are cross-sectional views of various prior art wound golf balls.
Figure 2:
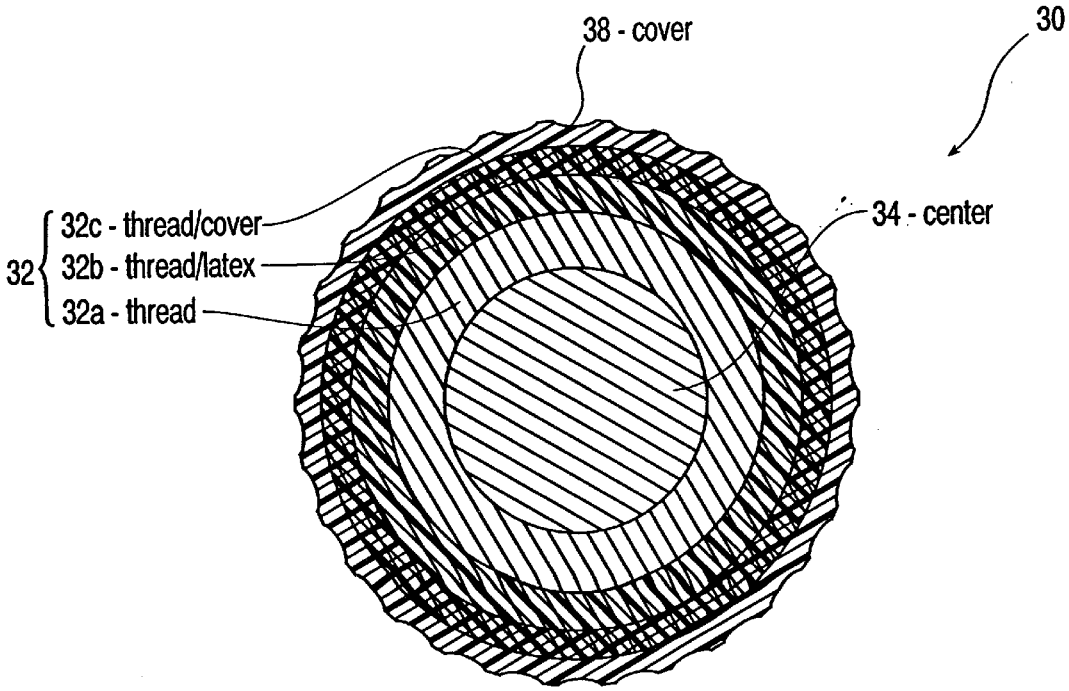
FIG. 2 PRIOR ART
Figure 3:
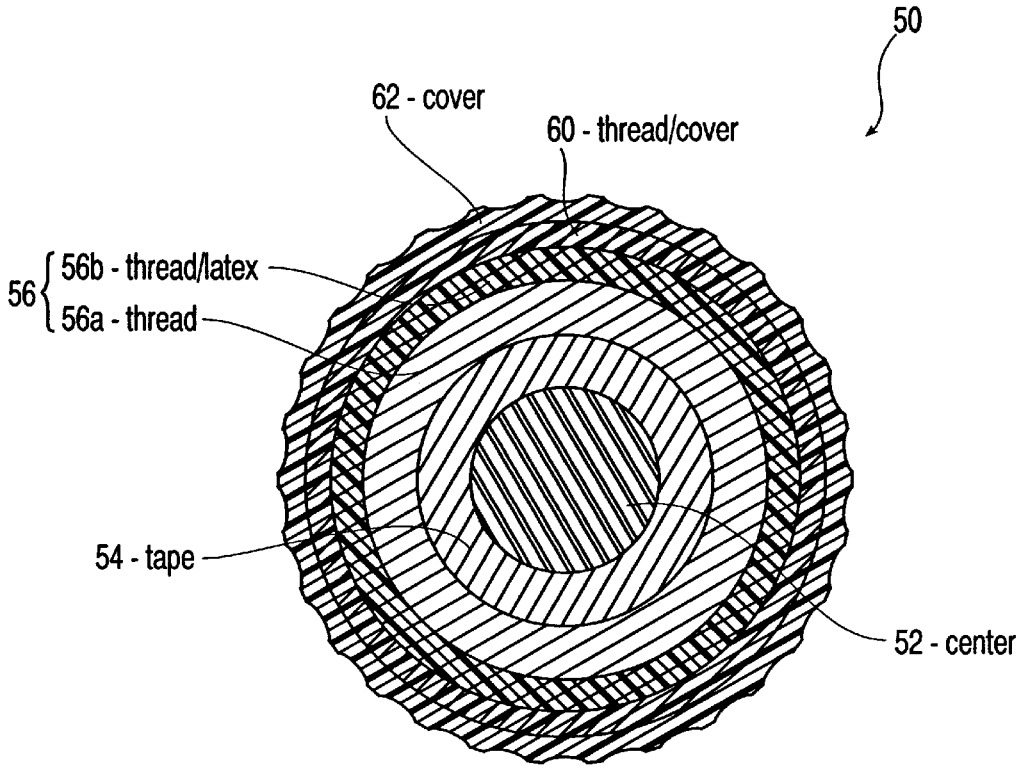
FIG. 3 PRIOR ART
Figure 4:
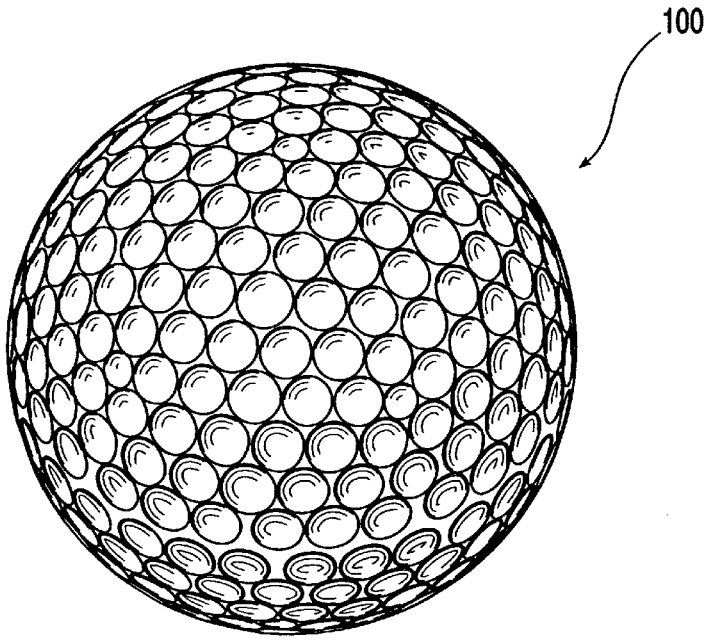
FIG. 4 is an elevational view of a wound golf ball according to the present invention.
Figure 5:
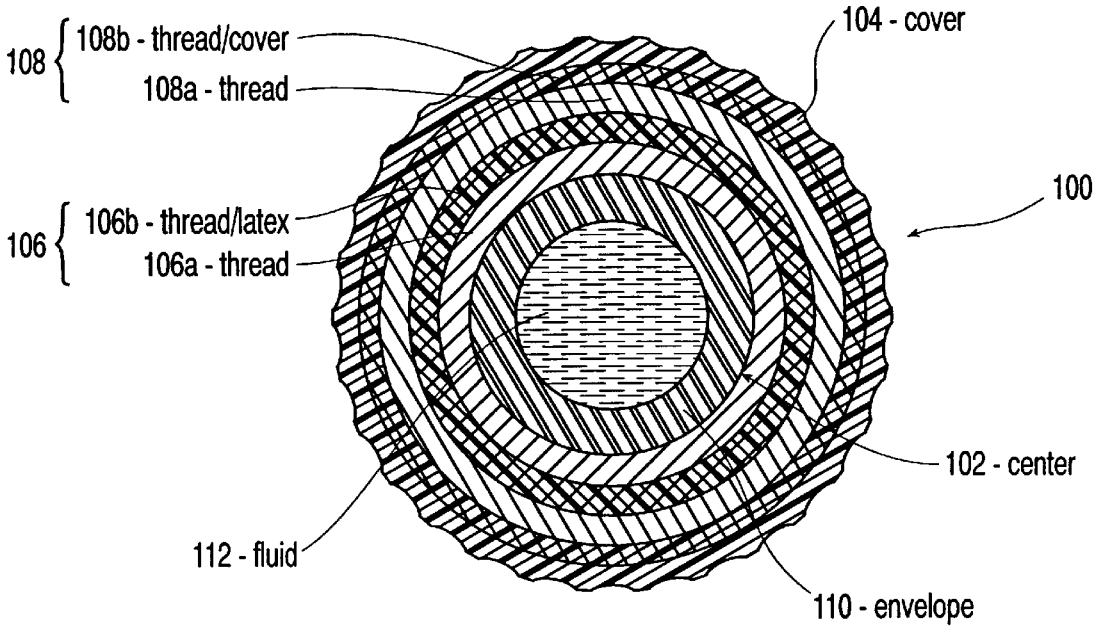
FIG. 5 is a cross-sectional view of the wound golf ball shown in FIG. 4 of the present invention.

Referring to FIGS. 4 and 5, this invention is particularly directed towards a wound golf ball 100 which comprises a fluid-filled center 102, at least one cover layer 104 and at least two thread wound layers 106 and 108 disposed therebetween. The thread wound layers form a wound layer which can be formed by a single continuous thread. However, it is preferred that the wound layer is formed of separate threads for each wound layer 106 and 108. The center 102 includes an envelope or shell 110 with a fluid 112 therein. In another embodiment, a solid center can be used in place of the fluid-filled center 102. The center components can have any composition and diameter and are known by those of ordinary skill in the art. The cover 104 is formed of conventional materials, such as balata, gutta percha, ionomer resin, polyurethane or a combination of the foregoing. The cover is either a single or multi-layer construction comprising materials known in the art.

The thread wound first layer or innermost layer 106 is formed of an elastic thread that is elongated prior to being wrapped about the center 102 as is conventional in the art. The first layer 106 and center 102 form an inner wound core. This inner wound core is submerged in a material that is in a liquid state. As a result, the liquid material partially impregnates the first layer 106 to a predetermined depth. The material is permitted to dry and forms a flexible film. After this submersion, the first layer 106 defines an untreated portion 106*a* and a latex impregnated portion 106*b*. The untreated portion 106*a* is adjacent the center 102. The untreated portion 106*a* includes threads with the gaps between the threads filled with air. The impregnated portion 106*b* extends from the untreated portion 106*a* to the outer surface of the first layer 106. In the impregnated portion 106*b*, the liquid material fills the gaps between the threads. During dipping, as the liquid material moves inward into the first layer 106, it replaces substantially all of the air trapped between the threads in that portion, and traps air in the untreated portion 106*a*. Thus, the air is trapped below the surface of the inner wound core.

The thread wound second layer or outermost layer 108 is formed of an elastic thread that is elongated prior to being wrapped about the inner wound core first layer 106, as is conventional in the art. The second layer of windings 108 and the inner wound core form the multi-layered wound core of the present invention.

The cover material is applied to the multi-layered wound core second layer 108 so that the cover material partially impregnates the second layer 108. After the cover is applied, the second layer 108 defines an untreated portion 108*a* and a cover impregnated portion 108*b*. The untreated portion 108*a* is adjacent to the impregnated portion 106*b*, and includes threads with the gaps between the threads filled with air. The cover impregnated portion 108*b* extends from the untreated portion 108*a* to the outer surface of the second layer 108. The cover impregnated portion 108*b* has the cover material between the threads. Thus, the wound layer segment includes as disposed in a radially outwardly extending direction, a first untreated portionl106a, a first impregnated portion 106*b*, a second untreated portion 108*a*, and a second impregnated portion 108*b*. The remainder of the cover material encases the multi-layered wound core or the wound layer segment, and forms the cover layer 104. Formation of the cover is discussed below.

The multi-layered wound core can be defined in terms of the apportionment of the radial thickness of the inner and outer wound layers. Specifically, the percentage of the thickness of each layer 106, 108 versus the total wound layer thickness can be expressed. The total wound layer thickness is the thickness of the two layers 106, 108 combined.

The radial thickness of the first and second layers 106 and 108 may vary so that ball properties, such as coefficient of restitution and compression, can be controlled. It may be preferred to control these thicknesses to form a ball that improves the ball performance for a specific type of player. In one embodiment, the percentage of the thickness of the first layer 106 is greater than 60% of the total wound layer thickness. The percentage of the thickness of the second layer 108 is less than 40% of the total wound layer thickness. More preferably, the first layer 106 thickness is a greater than 80% of the total wound layer thickness, and the second layer 108 thickness is less than 20% of the total wound layer thickness. Most preferably, the first layer thickness 106 is greater than 90% of the total wound layer thickness. These values allow the latex material and cover material to have a depth which affords good feel.

The tension used for wrapping the thread windings can be the same for the first and second layers 106 and 108 or different depending on the performance desired. Furthermore, the ball is not limited to using the same type of thread for each layer. Thread with different material properties, dimensions, and cross-sectional shapes may be used for each layer. The material properties of the threads that can be varied include, for example, ultimate or maximum elongation and tensile modulus. Furthermore, threads of the distinct layers can be made by either the same or different manufacturing processes. The processes that may be employed to produce threads for use in the present invention include slicing rubber sheets prepared from calendered solid rubbers, slicing rubber sheets prepared from curing latex rubber, or extruding thread from latex rubber. In addition, the winding patterns used for each layer can be the same or varied.

In the present specification and appended claims "liquid material" means the material into which the inner wound core is submerged and can be any material that has a liquid state and dries to form a flexible film. Recommended liquid materials include but are not limited to latex materials, liquid polybutadiene, liquid isoprene, liquid block copolymers, liquid silicones, epoxies, castable urethanes, any emulsified elastomer, many paints and coatings. Latex material means any material that when in a solid state can be extended under ambient conditions at least twice its resting length, and upon stress release can return to within 15% of its original length. Some examples of latex materials include but are not limited to latexes of natural rubber, latexes of synthetic rubbers including isoprene and neoprene, acrylic latex, nitrile latex, polychloroprene latex, stryene-butadiene latex, vinyl pyridine latex, and liquid isoprene. The preferred method of application of the liquid is submersion of the wound core in a bath; however, other methods can be used. It is useful in this invention that the liquid dry to a reasonably tack-free film or a film which can be rendered tack-free by exposure to heat or radiation. An important consideration is the ability of the bath material to deposit a film, which penetrates the gaps between the threads and effectively forms a distinct portion within the inner wound core and further separates the inner windings from the outer windings.

The preferred liquid material is a heavy latex material, which forms a heavy latex film. A heavy latex film is formed with about 30% to about 70% solids and applied using submersion times of about 10 seconds to about 60 seconds. However, a heavy latex film can be formed with less than 30% solids, if the submersion time is increased accordingly or with more than 70% solids if the submersion time is decreased accordingly. The preferred heavy latex material has about 52% solids and is applied using a submersion time of about 30 seconds. Recommended, commercially available latex materials include Natural Latex Compound 001704 manufactured by Heveatex Corporation, and a polyisoprene latex manufactured by Hartex under the name Hartex 103.

The density of the liquid material can be increased by incorporating high density fillers into the material, for example zinc oxide, barytes, tungsten oxide, and metallic flakes. The high density liquid material decreases the density requirement of the more central portion of the ball. While this has a minor beneficial effect of increasing the moment of inertia, its principal purpose is to provide a softer center.

A lower density center is softer and it is well documented that softer centers exhibit lower spin.

Conventionally, wound balls are covered via compression molding. Recently, wound balls have been covered with a polyurethane cover applied in a casting process. A requirement of the casting process is the application of the light latex material to the outer surface of the wound core. This treatment traps air within the wound core to eliminate bubble formation in the cover during the casting process and additionally prevents the wound core from unraveling during the casting process. The application of the light latex material as part of the casting process differs substantially from the present invention. The dip process of the present invention seeks to create a heavier application of latex through the use of a higher solids content and/or longer submersion times. In addition, the latex impregnated portion of the present invention is sandwiched between two untreated thread portions.

If a casting process is used to form the cover on the multi-layered wound core, then the core will have heavy latex material therein and light latex material on the outer surface. The heavy latex material is as described above, and the light latex material can be formed of about 5% solids with a submersion time of about eight seconds or less.

Figure 6:
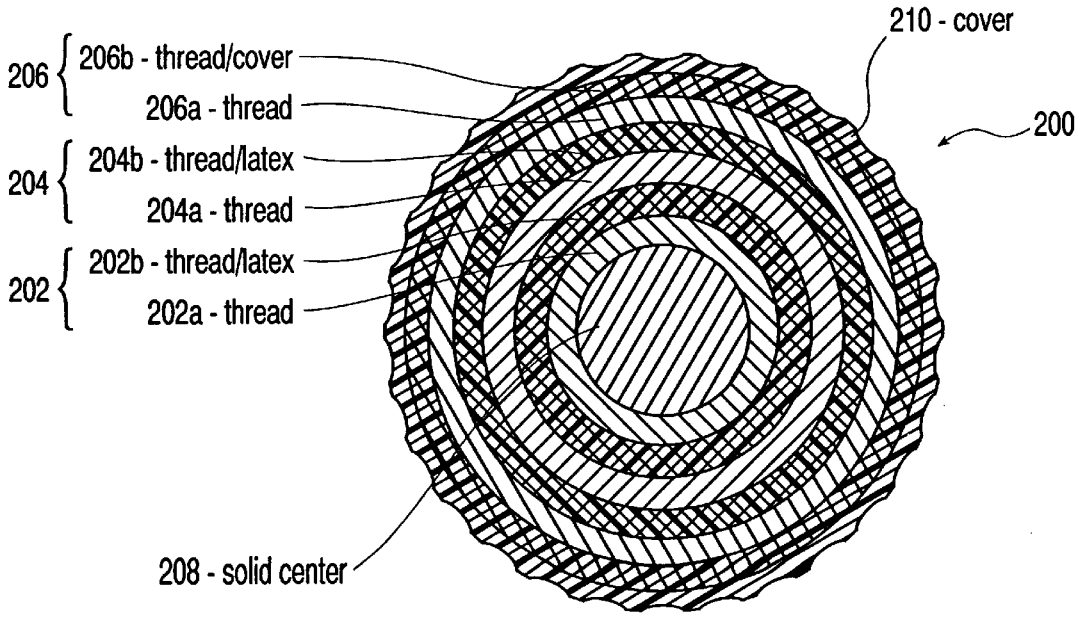
FIG. 6 is a cross-sectional view of another embodiment of the wound golf ball of the present invention.

Referring to FIG. 6, the golf ball 200 has been modified to include three thread wound layers 202, 204, 206 about a solid center 208. The first layer 202 has an untreated portion 202*a* and an impregnated portion 202*b*, as discussed above. The second layer 204 is wrapped about the first layer 202 and the third layer 206 is wrapped on the second layer 204. The second layer 204 has an untreated portion 204*a* and an impregnated portion 204*b*, as discussed above. A cover 210 surrounds the third layer 206 and partially impregnates the third layer to form an untreated portion 206*a* and a cover impregnated portion 206*b*, as discussed above. The present invention is not limited to three wound layers and may include more.

EXAMPLES

These and other aspects of the present invention may be more fully understood with reference to the following non-limiting examples, which are merely illustrative of the preferred embodiments of the present invention golf ball core, and are not to be construed as limiting the invention, the scope of which is defined by the appended claims.

Table I provides test data obtained from measuring various golf balls. In particular, ATTI compression and coefficient of restitution were measured for two Comparative Example balls and two balls according to the present invention.

In Comparative Example 1, which is a wound ball construction similar to balls found in the prior art, the single thread wound layer has a diameter is 1.58 inches. The wound core was dipped in a light latex material prior to casting the polyurethane cover, but no heavy latex material was applied.

In Comparative Example 2, which is a wound ball construction similar to balls found in the prior art, the first wound layer has a diameter of 1.550 inches, and the second wound layer has a diameter of 1.580 inches. The multi-layered wound core was dipped in a light latex material prior to casting the polyurethane cover, but no heavy latex material was applied.

In Example 1, which is an inventive ball, the first or inner wound layer has a diameter of 1.550 inches, and the second or outer wound layer has a diameter of 1.580 inches. The inner wound core with the inner wound layer was dipped in a heavy latex material formed with about 52% solids for 30 seconds. After the latex material dried, the outer wound layer was wrapped thereon, and the cover material applied. Prior to casting the polyurethane cover material, the multi-layered wound core was dipped in a light latex material.

In Example 2, which is an inventive ball, the first or inner wound layer has a diameter of 1.400 inches, and the second or outer wound layer has a diameter of 1.58 inches. The inner wound core with the inner wound layer was dipped in a heavy latex material formed with about 52% solids for 30 seconds. After the latex material dried, the outer wound layer was wrapped thereon, and the cover material applied. Prior to casting the polyurethane cover material, the multi-layered wound core was dipped in a light latex material.

TABLE I

Test Results

| Characteristic | Comparative Examples 1 | Comparative Examples 2 | Example 1 | Example 2 |
|---|---|---|---|---|
| center diameter (inches) | 1.130 | 1.130 | 1.130 | 1.130 |
| inner wound layer diameter (inches) | 1.580 | 1.550 | 1.550 | 1.400 |
| submersion time in heavy latex material (seconds) | 0 | 0 | 30 | 30 |
| outer wound layer diameter (inches) | 0 | 1.580 | 1.580 | 1.580 |
| % total wound layer thickness formed by inner wound layer | 100 | 93.3 | 93.3 | 60.0 |
| % total wound layer thickness formed by outer wound layer | 0 | 6.7 | 6.7 | 40.0 |
| ATTI Compression | 97 | 97 | 96 | 101 |
| Coefficient of Restitution | 0.795 | 0.794 | 0.805 | 0.800 |

Compression is measured by applying a fixed 200 lb load to a golf ball or core and measuring its deflection. The compression tester used is manufactured by ATTI Engineering of New Jersey, and is known by those of ordinary skill in the art.

One way of measuring ball resiliency is the coefficient of restitution (COR). The COR is measured by firing a ball from an air cannon into a steel plate. The velocity is measured both before the ball strikes the plate and afterward. The COR is the ratio of the two velocities (i.e., after impact to before impact). The greater the velocity after impact, as compared to the velocity before impact, the higher the COR.

As shown by test data above, the inventive golf ball of Example 1 has a compression of 96 points, similar to the compression of 97 points of the Comparative Examples 1 and 2. However, the COR of the ball of Example 1 is 0.805, which is greater than the COR of 0.795 and 0.794 of the Comparative Examples, respectively. This difference is significant for a golf ball.

The latex impregnated portion of the ball of Example 1 is closer to the outer surface of the wound core than the latex impregnated portion of the ball of Example 2, since the inner wound layer diameter of Example 1 is greater than that of Example 2. Comparing the inventive balls of Examples 1 and 2, it is evident that locating the latex impregnated portion closer to the outer surface of the wound core provides a greater increase in COR without adversely increasing compression.

Golf balls of the present invention achieve an enhanced velocity evidenced in the higher COR without decreased durability. It is critical for wound golf ball durability that the cover amalgamates with the wound layer at the surface of the wound core. While applying a heavy latex treatment directly on the surface can increase ball velocity, it simultaneously interferes with cover-core amalgamation. By applying a second wound layer to surround a first wound layer to which a heavy latex treatment has been applied, improved velocity can be attained without sacrificing durability. This higher COR means the velocity of the inventive ball is greater than that of the balls Comparative Examples.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments which would come within the spirit and scope of the present invention.

We claim:

1. A golf ball comprising:

a center;

a wound layer segment surrounding the center, said wound layer segment having as disposed in a radially outwardly extending direction a first untreated portion, a first impregnated portion, a second untreated portion and a second impregnated portion; and a cover layer surrounding the wound layer segment.

2. A golf ball comprising:

a center;

a first wound layer surrounding the center, said first layer having a first untreated portion and a first impregnated portion impregnated with a first material;

a second wound layer surrounding the first layer to form a wound core, the second layer having a second untreated portion and a second impregnated portion impregnated with a second material; and a cover layer surrounding the wound core.

3. The golf ball of claim 2, wherein the first untreated portion is adjacent the center, the first impregnated portion surrounds the first untreated portion, the second untreated portion is adjacent the first impregnated portion, and the second impregnated portion surrounds the second untreated portion.

4. The golf ball of claim 2, wherein the first layer has a first thickness, the second layer has a second thickness, the first thickness and the second thickness define a total wound thickness, and the first thickness comprises at least about 60% of the total wound thickness.

5. The golf ball of claim 4, wherein the first thickness comprises at least about 80% of the total wound thickness.

6. The golf ball of claim 4, wherein the first thickness comprises at least about 90% of the total wound thickness.

7. The golf ball of claim 2, wherein the first material has a liquid state and dries to form a flexible film.

8. The golf ball of claim 2, wherein the first material is selected from the group consisting of latex material, liquid polybutadiene, liquid isoprene, liquid block copolymers, liquid silicones, epoxies, castable urethanes, emulsified elastomers, paints or coatings.

9. The golf ball of claim 8, wherein the latex material is selected from a group consisting of latexes of natural rubber, latexes of synthetic rubbers, acrylic latex, nitrile latex, polychloroprene latex, stryene-butadiene latex, and vinyl pyridine latex.

10. The golf ball of claim 2, wherein the first material further includes high density fillers.

11. The golf ball of claim 10, wherein the high density fillers are selected from a group consisting of zinc oxide, barytes, tungsten oxide or metal fillers.

12. The golf ball of claim 2, wherein the second layer further includes a third material partially impregnated therein, and the third material is a latex material including about 5% solids.

13. The golf ball of claim 12, wherein the second material is a castable elastomer, and forms the cover layer.

14. The golf ball of claim 2, wherein the second material includes at least one ionomer, and forms the cover layer.

15. The golf ball of claim 2, wherein the second material includes a blend of rubbers including natural balata or transpolyisoprene, and forms the cover layer.

16. The golf ball of claim 2, wherein the wound core further includes a third wound layer surrounding the second layer, the third layer having a third untreated portion, and a third material partially impregnated in the third layer to define a third impregnated portion, and the third material forms the cover layer.

17. A method of forming a golf ball, wherein the method comprises:

forming a center;

winding a first thread around the center thereby forming an inner wound core having a first wound layer surrounding the center;

submerging the inner wound core in a first material in a liquid state so that the first material partially impregnates the first wound layer to define a first untreated portion and a first impregnated portion;

winding a second thread around the inner wound core thereby forming a multi-layered wound core having a second wound layer; and applying a cover material on the multi-layered wound core so that a portion of the cover material partially impregnates the second wound layer to define a second untreated portion and a second impregnated portion.

18. The method of claim 17, wherein the first material includes between about 30% to about 70% solids and the step of submerging the inner wound core further includes using a submersion time between about 10 seconds to about 60 seconds.

19. The method of claim 17, wherein the first material includes about 52% solids and the step of submerging the inner wound core further includes using a submersion time of about 30 seconds.

20. The method of claim 17, wherein prior to applying the cover material the method further includes submerging the multi-layered wound core in a second material in a liquid state so that the second material impregnates the second wound layer.

21. The method of claim 20, wherein the second material includes about 5% solids and the step of submerging the multi-layered wound core further includes using a submersion time of about 8 seconds or less.

22. The method of claim 21, wherein the step of applying the cover further includes casting the cover onto the multi-layered wound core.

* * * * *